US008226130B2

(12) United States Patent
Alfredsson et al.

(10) Patent No.: US 8,226,130 B2
(45) Date of Patent: Jul. 24, 2012

(54) CONTROL ROLLER MECHANISM-ACTIVATOR

(75) Inventors: Benkt-Ake Alfredsson, Bodafors (SE); Jasmin Insanic, Jonkoping (SE)

(73) Assignee: Industrilås i NässjöAB, Nässjö (SE)

( * ) Notice: Subject to any disclaimer, the term of this patent is extended or adjusted under 35 U.S.C. 154(b) by 0 days.

(21) Appl. No.: 11/298,879

(22) Filed: Dec. 9, 2005

(65) Prior Publication Data

US 2007/0138800 A1 Jun. 21, 2007

(51) Int. Cl.
*E05C 1/02* (2006.01)

(52) U.S. Cl. ..... 292/137; 292/193; 292/341.15

(58) Field of Classification Search ..... 292/137, 292/340, 341.11, 341.15, 341.17, 252, 9, 292/15, 23, 75, 79, 77, 193 X
See application file for complete search history.

(56) References Cited

U.S. PATENT DOCUMENTS

| | | | | |
|---|---|---|---|---|
| 958,815 A | | 5/1810 | Markham | |
| 1,391,114 A | * | 9/1921 | Huber | 292/169 |
| 1,534,584 A | | 4/1925 | Frederick | |
| 1,716,536 A | | 6/1929 | Sieben | |
| 1,720,304 A | | 7/1929 | Toncray | |
| 1,763,638 A | * | 6/1930 | Bonner | 292/254 |
| 1,812,334 A | | 6/1931 | Gloekler | |
| 1,995,338 A | | 3/1935 | Andrews | |
| 2,034,746 A | | 3/1936 | Ciak et al. | |
| 2,160,611 A | | 5/1939 | Alexander | 292/348 |
| 2,215,914 A | * | 9/1940 | Coffey | 292/45 |
| 2,219,626 A | | 10/1940 | Johnson | 74/535 |
| 2,459,920 A | | 1/1949 | Clark | 70/223 |
| 2,473,937 A | | 6/1949 | Cameron | 70/348 |
| 2,701,735 A | | 2/1955 | Segal | 292/348 |
| 2,707,121 A | | 4/1955 | Behnke | 292/348 |
| 2,844,020 A | | 3/1958 | Chitturn et al. | 70/97 |
| 2,851,871 A | | 9/1958 | Newell | 70/150 |
| 2,859,430 A | | 11/1958 | O'Callaghan | 340/274 |
| 2,949,328 A | | 8/1960 | Kaiser | 292/207 |
| 3,096,114 A | | 7/1963 | Trammell | 292/336.3 |
| 3,159,994 A | | 12/1964 | Schulz | 292/336.3 |
| 3,451,702 A | * | 6/1969 | Little | 292/99 |
| 3,652,112 A | | 3/1972 | Panelli | 292/210 |
| 3,831,580 A | * | 8/1974 | McLean | 126/197 |
| 3,871,198 A | | 3/1975 | Miller | 70/146 |
| 3,899,204 A | | 8/1975 | Ulrich | 292/336.3 |
| 4,031,730 A | | 6/1977 | Kern | 170/419 |
| 4,057,003 A | | 11/1977 | Atchisson | 89/138 |
| 4,099,593 A | | 7/1978 | Schultz | 180/114 |

(Continued)

FOREIGN PATENT DOCUMENTS

DE 9207268 9/1993

(Continued)

*Primary Examiner* — Carlos Lugo
*Assistant Examiner* — Mark Williams
(74) *Attorney, Agent, or Firm* — Vidas, Arrett & Steinkraus, P.A.

(57) ABSTRACT

The present invention relates to a latching device for a slide rod system incorporated into a door. The latching device includes a keeper plate engaged to the slide rod, a positioning bracket engaged to a door, and a roller bracket having a roller adapted for engagement to the positioning bracket and the keeper plate. The slide rod and keeper plate are adapted for positioning within a slide channel. The roller bracket is adapted for engagement to a doorframe channel. The positioning bracket includes a slot which receives the roller whereupon the keeper plate is at least partially manipulated vertically to maneuver the keeper to the rear of the roller to accomplish latching of a door.

21 Claims, 3 Drawing Sheets

U.S. PATENT DOCUMENTS 4,103,945 A 8/1978 Turman ..... 292/100
4,216,985 A 8/1980 Sorensen ..... 292/336.3
4,229,956 A 10/1980 Thorburn ..... 70/129
4,230,352 A * 10/1980 Sealey et al. ..... 292/341.17
4,237,710 A 12/1980 Cardozo ..... 70/108
4,389,930 A * 6/1983 Rutschilling ..... 100/88
D271,562 S 11/1983 Weinerman
4,470,277 A 9/1984 Uyeda ..... 70/118
4,502,720 A 3/1985 Fayerman et al. ..... 292/348
4,550,581 A 11/1985 Best et al. ..... 70/422
4,583,775 A 4/1986 Bisbing ..... 292/64
4,623,178 A 11/1986 Beringer et al. ..... 292/173
4,667,994 A 5/1987 Foshee ..... 292/358
4,706,478 A 11/1987 Swan et al. ..... 70/208
4,732,418 A 3/1988 Crown ..... 292/207
4,763,935 A 8/1988 Bisbing ..... 292/66
4,827,614 A 5/1989 Mitchell ..... 30/151
4,941,336 A 7/1990 Steckler ..... 70/365
4,979,767 A 12/1990 Lin ..... 292/336.3
4,989,907 A 2/1991 Edmonds et al. ..... 292/223
5,015,019 A 5/1991 Razdolsky ..... 292/200
5,172,944 A 12/1992 Munich et al. ..... 292/39
5,184,853 A 2/1993 Whatley ..... 292/205
5,236,234 A 8/1993 Norman ..... 292/201
5,259,091 A 11/1993 Mordick ..... 16/292
D343,347 S 1/1994 Lau et al. ..... D8/301
5,292,189 A 3/1994 Lau et al. ..... 312/265.3
5,295,720 A * 3/1994 Budde ..... 292/201
5,299,597 A 4/1994 Fort ..... 70/203
5,301,389 A 4/1994 Engel et al. ..... 16/422
5,307,653 A 5/1994 Davis ..... 70/56
5,339,659 A 8/1994 Guzzinati ..... 70/120
5,390,517 A 2/1995 Yamada ..... 70/210
5,408,853 A 4/1995 Yamada ..... 70/210
D360,345 S 7/1995 Swan et al. ..... D8/308
5,469,725 A 11/1995 Yamada ..... 70/208
5,474,339 A 12/1995 Johnson
5,481,889 A 1/1996 Richard et al.
5,484,176 A * 1/1996 Sallwasser ..... 292/137
5,509,700 A 4/1996 Kennedy, Jr.
5,509,703 A 4/1996 Lau et al.
5,520,427 A 5/1996 Mader ..... 292/336.3
5,526,660 A 6/1996 Bennett et al.
D371,300 S 7/1996 Mordick ..... D8/343
5,566,992 A 10/1996 Anderson
5,577,782 A 11/1996 Johnson et al.
5,582,042 A 12/1996 Mordick
5,582,443 A 12/1996 Finkelstein et al. ..... 292/202
5,584,515 A 12/1996 Silye
5,595,408 A 1/1997 Jeche
5,620,290 A 4/1997 Homfeldt et al. ..... 411/533
5,621,251 A 4/1997 Yamazaki
5,630,632 A 5/1997 Swan ..... 292/240
5,632,070 A 5/1997 Wakabayashi ..... 24/419
5,634,357 A 6/1997 Nutter ..... 70/210
5,642,909 A 7/1997 Swan et al. ..... 292/39
5,664,448 A 9/1997 Swan ..... 70/203
5,666,695 A 9/1997 Jegers et al. ..... 16/381
D385,768 S 11/1997 Nutter et al. ..... D8/308
5,683,005 A 11/1997 Mordick ..... 220/3.7
5,700,044 A 12/1997 Wartian
5,704,100 A 1/1998 Swan ..... 24/656.6
D391,143 S 2/1998 Jancsek ..... D8/338
5,722,121 A 3/1998 Lau et al. ..... 16/381
5,732,575 A 3/1998 Kaveney ..... 70/2
D396,397 S 7/1998 Swan ..... D7/331
5,775,145 A 7/1998 Kasper ..... 70/367
5,803,655 A 9/1998 Furuya ..... 403/398
5,806,351 A 9/1998 Learnahan ..... 70/56
D400,076 S 10/1998 Jancsek et al. ..... D8/331
5,862,690 A 1/1999 Jancek ..... 70/224
5,879,035 A 3/1999 Jancsek et al. ..... 292/202
5,899,508 A 5/1999 Cetnar et al. ..... 292/216
D411,433 S 6/1999 Swan et al. ..... D8/306
5,927,014 A 7/1999 Goldenberg ..... 49/182
5,937,585 A * 8/1999 Tidbury et al. ..... 49/504
6,019,402 A 2/2000 Arabia, Jr. et al. ..... 292/216
6,039,363 A 3/2000 Sugimura et al. ..... 70/2
6,039,364 A 3/2000 Rieger et al.
6,045,168 A 4/2000 Johneson et al. ..... 292/216
6,053,543 A 4/2000 Arabia, Jr. et al. ..... 202/201
6,067,826 A 5/2000 Holloway et al. ..... 70/278.3
6,068,308 A 5/2000 Molzer ..... 292/336.3
6,086,308 A 7/2000 Sjogren et al. ..... 414/373
6,101,856 A 8/2000 Pelletier et al. ..... 70/472
6,131,967 A 10/2000 Kondo et al. ..... 292/201
6,145,354 A 11/2000 Kondo et al. ..... 70/279.1
6,257,154 B1 7/2001 Kasper ..... 109/73
6,263,712 B1 7/2001 Ramsauer ..... 70/208
6,293,130 B1 9/2001 Ramsauer ..... 70/2
6,293,712 B1 9/2001 Coutant ..... 395/704
6,318,770 B1 11/2001 Molzer ..... 292/336.3
6,354,119 B1 3/2002 Molzer ..... 70/210
6,427,501 B2 8/2002 Ramsauer ..... 70/208
6,474,119 B1 11/2002 Halvorson et al. ..... 70/208
6,494,509 B2 12/2002 Molzer ..... 292/336.3
6,532,778 B2 3/2003 Molzer et al. ..... 70/208
6,662,605 B2 12/2003 Molzer ..... 70/210
6,715,807 B2 4/2004 Molzer ..... 292/336.3

FOREIGN PATENT DOCUMENTS

EP 100 6247 6/2000

* cited by examiner

CONTROL ROLLER MECHANISM-ACTIVATOR

BACKGROUND OF THE INVENTION

This invention relates to control mechanism for use with a swing handle and flat rod system to latch a flat or slide rod within a bracket engaged to a door channel, to secure a metal door.

In the past, the known pivot lever bars, flat rods, and/or slide rods were used in conjunction with conventional latching devices where a portion of a slide rod would penetrate into a receiving slot to secure a metal door in a closed position relative to a doorframe.

The engagement of a portion of the slide rod within a receiving slot deterred the opening of the door in the absence of the manipulation of the swing handle. The problem with the known slide rod latching devices involved the lack of reliability and/or performance during prolonged use within a metal door. Use of the known slide rod latching devices frequently resulted in the undesirable bending of the slide rod, which in turn caused the distal end of the slide rod to deviate from alignment with the receiving slot of the latch. The failure of alignment between the distal end of the slide rod and the receiving slot of the latch rendered a door unlatchable relative to a doorframe.

One problem with the known prior art devices involved the rod guide and the latch point being located at different positions along a Y axis for the rod system. The separation of the rod guide from the latch point frequently permitted a door to flex at locations between the rod guide and the latch point. The known rod systems which separated the rod guide from the latch point placed an undesirable load on the rod system causing the rod system to flex during use. The flexing of the door, the placement of load on the rod system, and the flexing of the rod system, frequently caused damage to either the door or the rod system, rendering use of the door and rod latching system inoperative.

Another problem with the rod systems as known involved the difficulty of simultaneous orientation along both the X and Y axis of the rod guide and latch, as well as the door with the doorframe, prior to initiation of force upon the rod system. The lack of proper orientation of the rod guide and latch prior to manipulation of the control or swing handle frequently resulted in damage to either the rod system, the swing handle, and/or the door. In addition, the lack of proper orientation of the rod guide, latch, door and doorframe along the X and Y axis prior to the initiation of force on the rod system increased the wear on the door and rod system, resulting in accelerated maintenance expenses.

The misalignment between the rod guide, latch, door and/or doorframe, also frequently caused an operator to exert excessive force on a control handle, which in turn, may have caused the twisting of the rod system, the latch system, and/or the hinge. Damage to the rod guide, latch, door, hinge, and doorframe, frequently resulted.

Another problem with the rod latching systems as known involved the necessity to manipulate the rod system vertically into a latching position. The failure of a portion of the rod system, or rod control system during use, thereby increased the risk that the rod system would inadvertently descend due to gravity, separating the slide rod system from the engagement slot. A door would then become easily opened due to the loss of the latching mechanism.

These and other drawbacks of the prior art may be overcome by the disclosed invention.

A need therefore exists for a control mechanism for a slide rod device which minimizes misalignment between a keeper/stop and a bracket, to provide improved reliability during use in the latching of a door within a doorframe.

In general, the control mechanism for a door latch may be used with any desired metal door, or wherever a slide rod, pivot lever bar, and/or flat rod is used to engage a door within a doorframe.

BRIEF SUMMARY OF THE INVENTION

In general, the invention relates to a latching device incorporating a slide rod engaged to a door, a keeper plate having a keeper engaged to the slide rod, a positioning bracket having a slide channel and a roller slot engaged to the door, the slide channel receiving the slide rod, and a roller bracket having a roller engaged to a door channel, where the roller slot receives the roller and the keeper releasably engages the roller during the latching of a door within a door channel.

In general, the rod slide defines a vertical plane where the roller slot engages the roller substantially orthogonally relative to the vertical plane.

In general, the roller as engaged to the roller bracket is disposed substantially orthogonally relative to the vertical plane defined by the slide rod.

The invention may also include a keeper plate which is at least partially disposed in the slide channel of the positioning bracket when the keeper is engaged to the roller.

In general, the keeper of the keeper plate is adapted for positioning rearwardly with respect to the roller, being disposed between the roller and the back wall of the doorframe channel.

The keeper may include opposite ends, where each opposite end includes a beveled edge to facilitate positioning behind the roller during latching of the door.

In general, the keeper may be substantially perpendicular to the keeper plate.

The invention may include a positioning bracket having at least one bridge which forms at least a portion of the roller slot.

In general, the bridge also at least partially defines a keeper channel which is used to facilitate vertical manipulation of the slide rod for positioning of the keeper either proximate or distal to the positioning bracket during the latching or unlatching of a door.

The control mechanism may include a first release position where the keeper is disengaged from the roller.

The control mechanism may also include a latch positioned where the keeper is engaged to the roller.

In general, the roller bracket includes a roller mount which creates a separation distance between the roller and the back wall of the doorframe channel.

The control mechanism may include a slide rod engaged to a door, a keeper plate engaged to the slide rod, and a bracket having a latching member engaged to a door channel where the keeper plate is adapted for releasable engagement to the latching member.

In general, the control mechanism may include a slide rod engaged to a door, a keeper plate engaged to the slide rod, and a latching member engaged to a door channel, where the keeper plate is adapted for releasable engagement to the latching member.

BRIEF DESCRIPTION OF THE SEVERAL VIEWS OF THE DRAWING(S)

DETAILED DESCRIPTION OF THE INVENTION

Figures 1, 2:
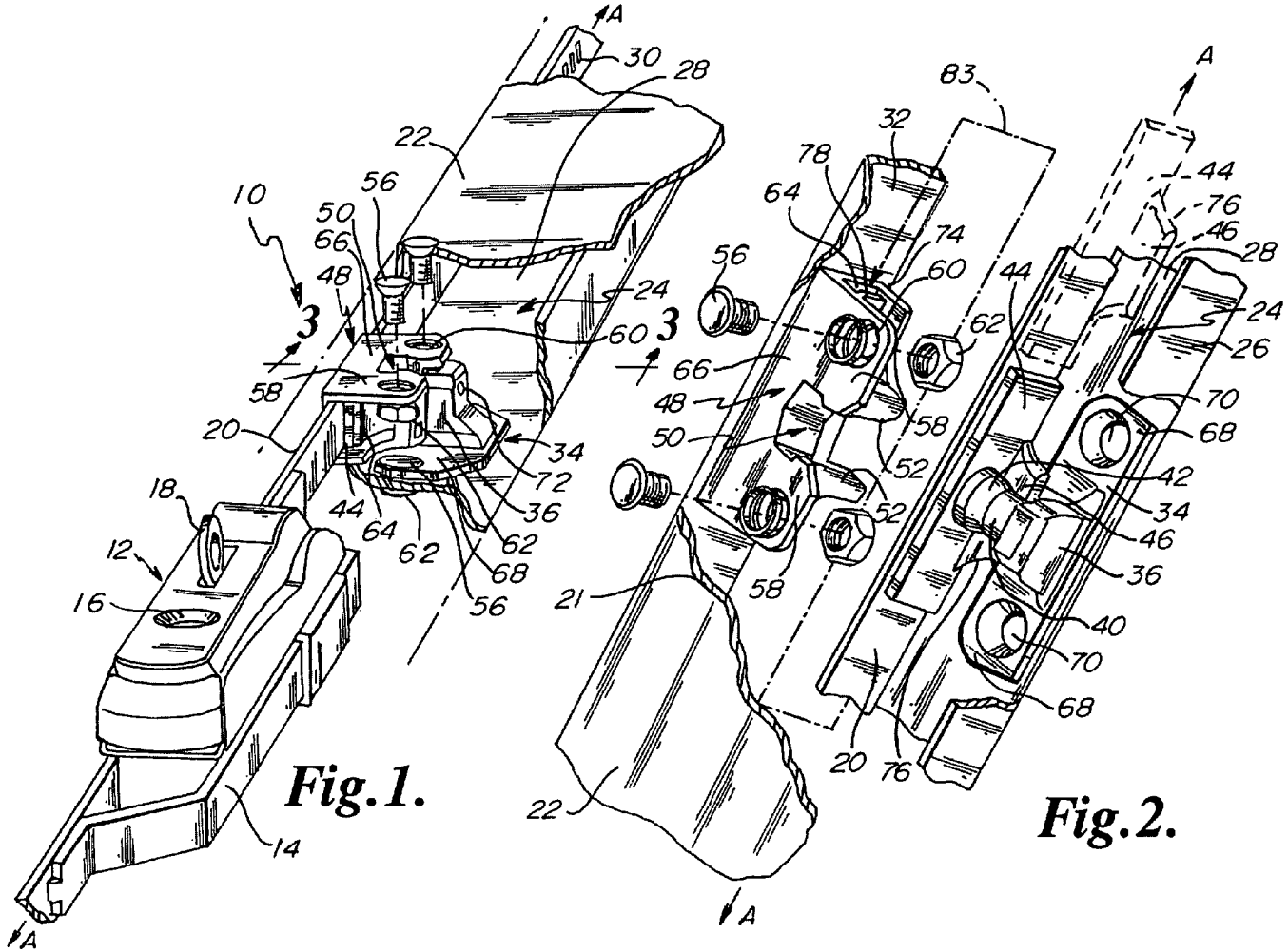
FIG. 1 is an environmental partial cut-away view of the control mechanism for the door latch.
FIG. 2 is a detail environmental partial cut-away and partial exploded view of the control mechanism for the door latch.

While this invention may be embodied in many different forms, there are described in detail herein specific embodiments of the invention. This description is an exemplification of the principles of the invention and is not intended to limit the invention to the particular embodiments illustrated.

For the purposes of this disclosure, likewise numerals in the figures shall refer to like features unless otherwise indicated.

Depicted in the figures are various aspects of the invention. Elements depicted in one figure may be combined with, and/or substituted for, elements depicted in another figure as desired.

In at least one embodiment of the invention the control mechanism for a door latch is referred to by the numeral 10. As may be seen in FIG. 1, the control mechanism for door latch 10 is used in association with a swing handle 12 as coupled to a swing handle support 14. The swing handle 12 may include a padlock hasp 18 and/or a lock 16. The swing handle 12 may also be operatively engaged to a flat or slide rod 20.

The swing handle 12 in some embodiments is constructed for pivotal clockwise or counter clockwise rotation to either elevate or descend the flat or slide rod 20 relative to a door 21 and doorframe channel 24. The swing handle 12 may be configured for either right or left handed operation at the discretion of a user.

In some embodiments, the control mechanism for door latch 10 may be engaged to a metal door 21 and a metal doorframe 24. The door 21 and doorframe channel 24 may be formed of any material in which a slide or flat rod 20 system is commonly used.

In some embodiments, the door 21 is formed of an exterior door surface 22 and a door edge 32. Likewise, in some embodiments the doorframe channel 24 is formed of a doorframe side wall 26, a doorframe back wall 28, and an enclosure 54.

In some embodiments, the swing handle 12 is engaged to a cog (not shown). The cog generally includes a plurality of teeth which are operatively engaged to a series of grooves integral to the flat or slide rod 20. Rotation of the swing handle 12 thereby imparts rotation to the cog which translates the motion through the teeth to either elevate or descend the flat or slide rod 20.

As may be seen in FIG. 1, in some embodiments the control mechanism for door latch 10 is formed of a positioning bracket 48 which is adapted for releasable placement about a roller bracket 34. The positioning bracket 48 may be attached to the exterior surface 22 of the door 21 by use of fasteners 56 which may be bolts and nuts, screws and/or rivets, or other fastening means including mechanical and/or adhesive fasteners. The positioning bracket 48 may be located adjacent to, but is not required to be in contact with, the interior of the door edge 32.

In one embodiment as depicted in FIG. 1, the positioning bracket 48 includes a roller slot 50 as adjacent to, and positioned between, at least one, and preferably two mounting areas 58. An aperture 60 may traverse each mounting area 58. A nut 62 may engage a fastener 56 to secure the positioning bracket 48 to the interior of a door 21.

The positioning bracket 48 in at least one embodiment includes a slide channel 64 which slideably receives a portion of the slide rod 20 and the keeper plate 44. The positioning bracket 48 may include a flat top wall or surface 66 which is preferably adapted for flush engagement to the interior of a door 21.

As may be seen in FIG. 1, in some embodiments, the control mechanism for door latch 10 includes a roller bracket 34. The roller bracket 34 is positioned in a doorframe channel 24. The roller bracket 34 is preferably attached to the back wall 28 of the doorframe channel 24 through the use of fasteners 56 which may be bolts, nuts 62, screws, rivets and/or any other mechanical, chemical or adhesive fastening means. The roller bracket 34 may include at least one mounting area 68, which in turn may have an affixation aperture 70. (FIG. 2)

In some embodiments, the roller bracket 34 includes a roller mount 36 which may include a pin aperture 72 adapted to receive a roller pin 38.

As may be seen in FIG. 1, in some embodiments, the flat or slide rod 20 includes a plurality of adjacent and regularly spaced positioning slots 30 which are adapted for the engagement of a keeper plate 44 to the flat or slide rod 20. The flat or slide rod 20 defines a plane of substantially linear motion identified by reference letter A. The manipulation of the swing handle 12 imparts movement to either elevate or descend the slide rod 20 relative to the control mechanism for door latch 10, and to thereby either elevate or drop the position of the keeper plate 44 relative to the positioning bracket 48 and the roller bracket 34 along plane A.

As may be seen in FIG. 2, in one embodiment, the keeper plate 44, the positioning bracket 48, and the roller bracket 34 are depicted in more detail.

As depicted in FIG. 2, in one embodiment, the keeper plate 44 is substantially flat, for flush engagement to the flat or slide rod 20. The keeper plate 44 may include a substantially perpendicular keeper or stop 46. The keeper or stop 46 may include a pair of opposite edges 76, which may be beveled to facilitate positioning behind the first and second rollers 40, 42 of the roller bracket 34.

In at least one embodiment, the positioning bracket 48 as depicted in FIG. 2 includes a pair of bracket bridges 52. The pair of bracket bridges 52, are preferably separated from each other to define a roller slot 50 therebetween. Each of the bracket bridges 52 may include a positioning ledge 78 as separated from a positioning bracket sidewall 80. (FIG. 6A) The positioning bracket 48 additionally may include a base wall 82. The space between the positioning bracket sidewall 80, the positioning ledges 78, the base wall 82, and the interior surface of the flat top wall or surface 66 defines the slide channel 64. (FIG. 6A)

In at least one embodiment, the positioning of the flat or slide rod 20, and the keeper plate 44, within the slide channel 64 is identified by arrow 83 of FIG. 2. The positioning bracket 48 and the slide channel 64 support the slideable positioning of the slide rod 20 and the keeper plate 44, relative to the interior surface of the door 21 and door edge 32.

In some embodiments, as depicted in FIG. 2, the roller bracket 34 is securely attached to the doorframe back wall 28 to position the first and second rollers 40, 42, for aligned normal insertion within the roller slot 50. The roller bracket 34 and a positioning bracket 48 are aligned for coupling therebetween during the latching of a door 21.

In at least one embodiment, as shown in phantom line in FIG. 2, the slide rod 20 may be manipulated to elevate the keeper plate 44 vertically along plane A. The vertical manipulation of the keeper plate 44 separates the keeper 44 from a latching position rearwardly of the first and second rollers 40, 42 to a first release position. The door 21 and a positioning bracket 48 may then be rotated about a door hinge (not shown) for orthogonal or normal separation of the roller slot 50 from the first and second rollers 40, 42. The slide channel 64 continues to hold the slide rod 20 and keeper plate 44 during the opening of the door 21 and the separation of the positioning bracket 48 from the roller bracket 34.

In at least one embodiment, as depicted in FIG. 2, a keeper plate 44 may be manipulated into a latching position, from a first release position, as depicted by the position of the keeper plate 44 shown in phantom line. When the keeper plate 44 and the slide rod 20 have been vertically manipulated to the first release position the door may be rotated about a hinge such that the positioning bracket 48, and the roller slot 50, are proximate to the roller bracket 34. The roller slot 50 is then preferably aligned with the first and second rollers 40, 42 for receipt thereof. Once the positioning bracket 48 and the rollers 50 have been orthogonally or normally rotated for surrounding engagement of the first and second rollers 40, 42, the swing handle 12 may be rotated to retract or descend the slide rod 20, and the keeper plate 44, for positioning of the keeper or stop 46 rearwardly of the first and second rollers 40, 42. The swing handle 12 may then be closed or locked to retain the keeper or stop 46 in a latching position relative to the roller bracket 34.

In at least one embodiment, the opposite edges 76 of the keeper or stop 46 may be beveled to facilitate the positioning of the keeper 46 rearwardly adjacent to the first and second rollers 40, 42.

In some embodiments, the first and second rollers 40, 42 have different diameters to facilitate releasable engagement to the keeper 46. The first and second rollers 40, 42 may include bearings to facilitate rotation thereof. The first and second rollers 40, 42 are preferably engaged to a roller pin 38 which in turn is attached to the roller mount 36. The roller pin 38 may extend perpendicularly outward from the forward face of the roller mount 36. The roller pin 38 is preferably elevated/separated from the doorframe channel back wall 28 to provide a separation distance to permit the slidable positioning of the keeper 46 adjacent to the first and second rollers 40, 42.

In some embodiments, the first and second rollers 40, 42, and the roller pin 38, may be replaced with a pin or rod. The first and second rollers 40, 42 and the roller pin 38 may alternatively be replaced with a tab or ledge as extending outwardly from bracket 34. It should be noted that the roller slot 50 may be any shape as desired to receive a roller, pin, rod, tab, or ledge of the bracket 34. The roller bracket 34 is therefore not required to include a roller, and a roller slot 50 is not restricted to the receipt of a roller during alignment and coupling of the positioning bracket 48 to bracket 34.

In at least one embodiment it is anticipated that the keeper 46 will releaseable engage a pin, rod, or other latching member 90 including, but not necessarily limited to, a tab or ledge.

In at least one embodiment, the positioning bracket 48 and the roller bracket 34 may be modified so that the slide rod 20 may be manipulated to permit the slideable positioning of the keeper 46 rearwardly, with respect to a latching member 90, to latch a door 21 relative to a door channel 24.

Figure 3:
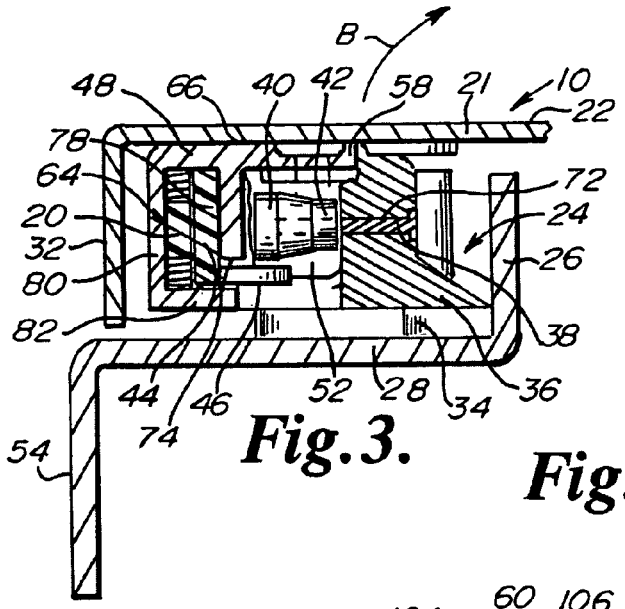
FIG. 3 is a cross-sectional side view of the control mechanism for the door latch taken along the line 3-3 of FIG. 1.

In one embodiment as depicted in FIG. 3, the positioning bracket 48 is shown in the latching position relative to the roller bracket 34. The positioning of the keeper 46 below or rearwardly with respect to the first and second rollers 40, 42 functions to prevent rotation and separation of the positioning bracket 48 outwardly away from the roller bracket 34 in an arc of rotation as depicted by arrow B.

In at least one embodiment as depicted in FIG. 3, the roller bracket 34 is separated from the door channel sidewall 26 within the doorframe channel 24 to provide a space therebetween. As depicted in FIG. 3, the mounting bracket side wall 80 is separated from the door edge 32 to provide a space therebetween.

In at least one embodiment as depicted in FIG. 3, the separation between the top surface of the base wall 82, and the bottom surface of the positioning ledge 78, defines the size of the keeper channel 74. The keeper channel 74 is preferably sufficiently large to permit sliding passage of the keeper 46 therethrough. As depicted in FIG. 3, the separation between the interior surface of the side wall 80, and the interior surface of the positioning ledge 78, defines the size of the slide channel 64. The slide channel 64 is preferably sufficiently wide to permit sliding passage of the slide rod 20 and keeper plate 44 therethrough.

In some embodiments the first roller 40 and second roller 42 facilitate the slidable positioning of the keeper 46 within channel 74, for positioning of the keeper 46 rearward to the first and second rollers 40, 42. The first roller 40 and the second roller 42 may each comprise roller bearings to facilitate positioning of the keeper plate 46 relative to the roller bracket 34. However, the first and second rollers 40, 42 are not required to incorporate bearings and may be rotated about roller pin 38.

In at least one embodiment, the roller pin 38 is fixedly secured to the pin aperture 72 of the roller mount 36. Alternatively, the roller pin 38 may be rotatably positioned within the pin aperture 72 of the roller mount 36.

Figure 4:
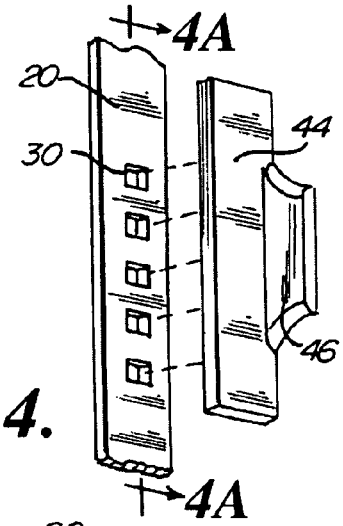
FIG. 4 is a detail isometric exploded view of a portion of the slide rod and keeper plate.
Figure 4A:
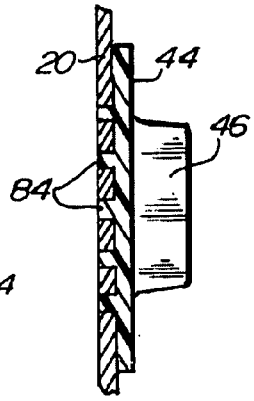
FIG. 4A is a detail cross-sectional side view of the slide rod and keeper plate taken along the line 4A-4A of FIG. 4.

Referring to FIGS. 4 and 4A, in at least one embodiment the slide rod 20 includes at least one, and preferably a plurality of, groupings of flat rod positioning slots 30. One or more groups of flat rod positioning slots 30 may be used to secure a keeper plate 44 to a slide rod 20. The rearward face of a keeper plate 44 preferably includes at least one, or a plurality of, regularly spaced tangs 84 which are adapted for insertion into individual flat rod positioning slots 30. The insertion of individual tangs 84 into the flat rod positioning slots 30 frictionally engages the keeper plate 44 to the flat rod 20. The keeper plate 44 may be fixedly secured and/or releasably attached to the flat or slide rod 20 as desired. The inclusion of groupings of flat rod positioning slots 30 assists to provide flexibility to the control mechanism for door latch 10, permitting an individual to adjustably engage a keeper plate 44 at a desired location along the flat rod 20. Standardization of the component of the flat or slide rod 20 may thereby be accomplished.

Figure 5:
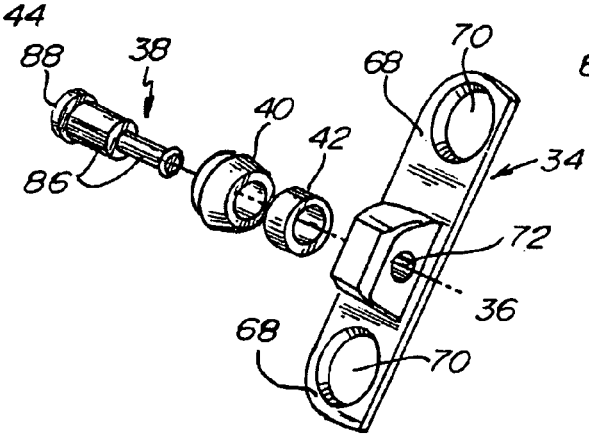
FIG. 5 is a detail isometric exploded view of the roller bracket.

In at least one embodiment, an exploded view of the roller bracket 34 is depicted in FIG. 5. A roller pin 38 may have one or more bearing surfaces 86 of differing diameter dimensions to facilitate engagement to one or more different types of first and second rollers 40, 42. The roller pin 38 may include an end shoulder 88 which may be used to retain the first and second rollers 40, 42 on the roller pin 38. The first and second rollers 40, 42 may be positioned between the interior surface of the roller mount 36 and the end shoulder 88. The roller pin 38 is also adapted for insertion into the pin aperture 72 for either fixed or rotational engagement thereto.

Figure 6:
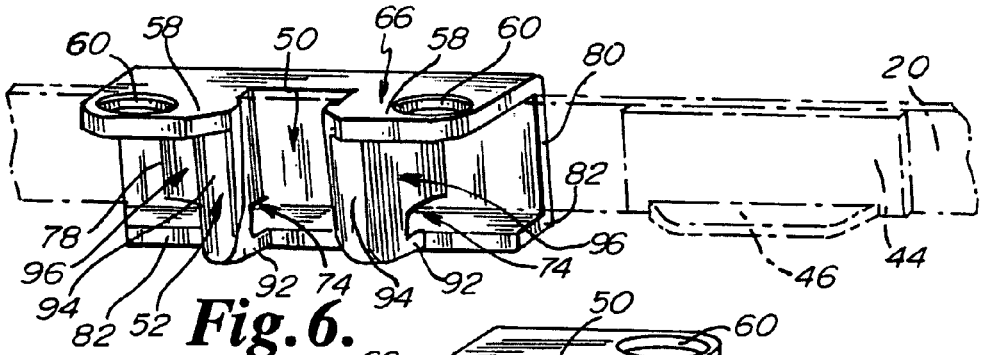
FIG. 6 is a detail isometric partial phantom line front view of the positioning bracket, keeper plate, and slide rod.
Figure 6A:
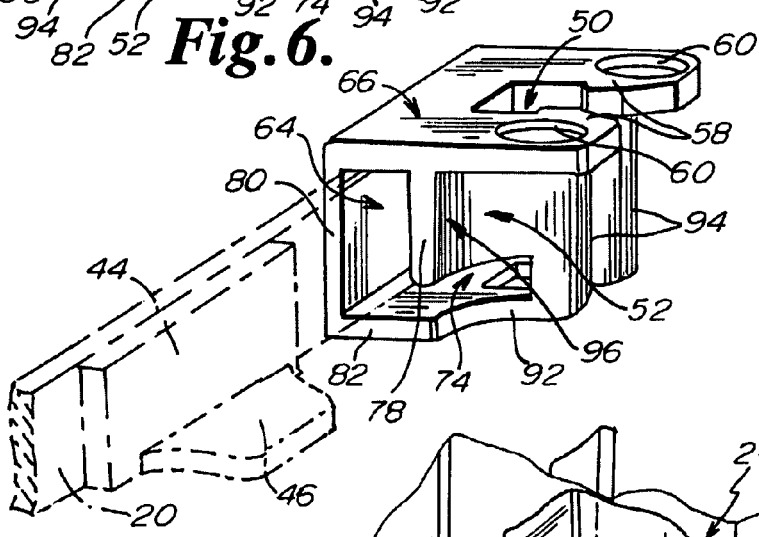
FIG. 6A is detail isometric partial view phantom line end view of the positioning bracket, keeper plate, and slide rod.

In at least one embodiment, a detail front view, and detail end view, of the positioning bracket 48 is depicted in FIGS. 6 and 6A. The positioning bracket 48 may be formed of a flat top surface 66, a sidewall 80, and a base wall 82, which in combination are generally U-shaped. The bracket bridge 52 preferably extends from the interior surface of the top wall 66 toward the back wall 82. The bracket bridge 52 may also be engaged to the exterior edge of the base wall 82 extending outwardly therefrom. A lower bridge extension 92 is generally defined as the section of the bridge bracket 52 extending between the base wall 82 and the leading crown 94. The bridge bracket 52 may include wing support sections 96 which transition into a positioning ledge 78. The transition between the leading crown areas 94 and the positioning ledge 78 along the wing support sections 96 may be substantially arcuate.

In at least one embodiment as depicted in FIGS. 6 and 6A, the position relationship with a slide rod 20, keeper plate 44 and keeper 46 within the slide channel 64 and keeper channel 74 is shown in detail.

Figure 7:
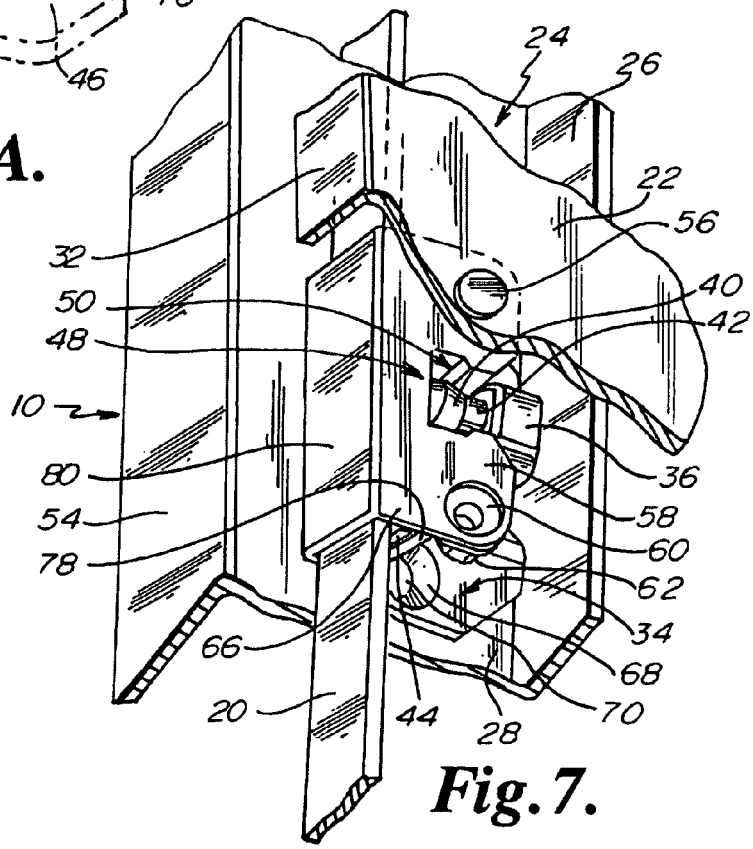
FIG. 7 is a detail partial cut-away view of the control mechanism for the door latch.

In at least one embodiment, the engagement of the positioning bracket 48 to the roller bracket 34 is shown in FIG. 7. As depicted in FIG. 7, the door 21 is disposed in the latching position relative to the doorframe channel 24. As depicted in FIG. 7, the swing handle 12 has been manipulated to dispose the keeper 46 rearwardly with respect to the first and second rollers 40, 42 to latch the positioning bracket 48 relative to the roller bracket 34 to securely close and latch a door.

During use, one or a plurality of control mechanisms for door latch 10 may be disposed above a swing handle 12, and one or the plurality of control mechanisms for door latch 10 may be disposed below a swing handle 12 to securely latch a door 21 within a doorframe channel 34.

The number of control mechanisms for door latch 10 utilized will be dependent upon the dimensions for the door and the security desired by an individual.

Figure 8:
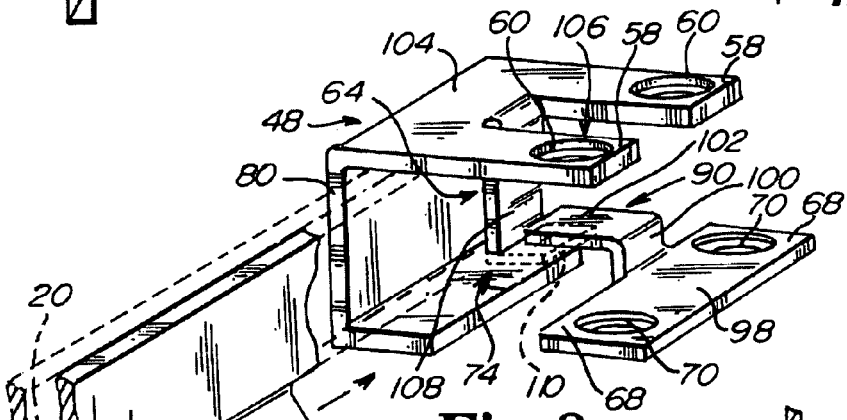
FIG. 8 is an isometric partial phantom line view of an alternative embodiment of the control mechanism for door latch.

In one alternative embodiment as depicted in FIG. 8, the roller bracket 34 has been replaced by a latching bracket 98. The latching bracket 98 includes mounting areas 68 and affixation apertures 70. Latching bracket 98 is adapted for affixation to the back wall 28 of the door frame channel 24, in a manner substantially identical to the roller bracket 34 as earlier described. The latching bracket 98 is substantially rectangular and includes latching member 90, extension 100, and mounting platform 102. The dimensions for the latching bracket 98, extension 100, and mounting platform 102 may vary provided that the dimensions selected are sufficient for operative engagement of a keeper 46 rearwardly of the latching platform 102 during use of the control mechanism for door latch 10.

In one embodiment as depicted in FIG. 8, the slide rod 20 having groups of positioning slots 30 is substantially identical to the embodiments as earlier described. The keeper plate 44 and keeper 46 preferably include tangs 84 as earlier described for adjustable positioning relative to, and engagement with the slide rod 20.

In one embodiment as depicted in FIG. 8, the positioning bracket 48 includes a top wall 104 having a central punch out slot 106 defining a substantially perpendicular positioning frame 108. The punch out slot 106 preferably defines mounting areas 58 which may include apertures 60. The positioning bracket 48 as depicted in FIG. 8 is engaged to the door 21 as separated from door edge 32 in a manner as earlier described.

In one embodiment as depicted in FIG. 8, positioning bracket 48 includes side wall 80 and base wall 82. The area between the interior of the side wall 80, above the base wall 82, interior of the positioning frame 108 and below or interior to the top wall 104, defines the slide channel 64 as earlier described. As depicted in FIG. 8, the area below the positioning frame 108 and above the base wall 82 defines the keeper channel 74. The positioning frame 108 preferably includes a shelf 110 (Shown in Phantom) which may assist in the positioning of the keeper 46 within the keeper channel 74. The keeper channel 74 may be defined as the area below the positioning frame 108 and shelf 110 and above the base wall 82.

In some embodiments, the latching member 90 may be configured as a pin, bar, ledge, tab, roller, and/or any other device for engagement to the keeper 46. The roller slot 50 and/or the central punch out slot 106 may be of any dimension and/or shape as depended upon the configuration for the latching member 90 as selected by an individual.

In some embodiments, the latching member 90 may be the shape of square, oval, rectangular, pin, bar, ledge, and/or may include a roller to facilitate engagement to a keeper 46. The extension 100 may be of any dimension as desired for separation of the mounting platform 102 from the back wall 28 for rearward positioning of the keeper 46.

In some embodiments, the positioning bracket 48 and roller bracket 34, or the positioning bracket 48 and latching bracket 98, are located at substantially identical, vertical positions along plane A with respect to the door 21 and door frame channel 24. The substantial vertical alignment between the positioning bracket 48 and the roller bracket 34, or latching bracket 98, minimizes the flex of a slide rod 20 and door 21 during use of the door latch 10 and the manipulation of the swing handle 12. The latching of a door 21 through the use of the control mechanism 10 relieves the slide rod 20 from any load, which in turn eliminates flex.

In some embodiments, the door 21 is aligned with plane A, and the door 21 is swung about a hinge (not shown) in a normal or perpendicular arc relative to plane A. The engagement and alignment between a positioning bracket 48 and the roller bracket 34, or latching bracket 98, occurs prior to the initiation of any compression forced being applied to the slide rod 20 through the swing handle 12. The engagement and alignment between the positioning bracket 48 and the roller bracket 34, or latching bracket 98, permits the door 21 to engage the door frame channel 24, which in some embodiments may include a gasket, without any side load on the slide rod 20. This configuration for the latch mechanism 10 facilitates and reduces the wear on any gasket, hinges, slide rod 20, door 21, and/or slide frame channel 24. The engagement and alignment of the positioning bracket 48 with the roller bracket 34, or latching bracket 98, enables an operator to manipulate the swing handle 12 with less force, which reduces risk of mechanical failure. The above described alignment of the positioning bracket 48 and roller bracket 34, or latching bracket 98, also reduces the application of twisting force on the slide rod 20, and latching system, as well as the hinge side of the door 21.

In some embodiments, the downward movement of the slide rod 20 occurs as a result of gravity and/or as a result of a combination of gravity and manipulation of a swing handle 12. The control mechanism for door latch 10 in at least one embodiment is designed to utilize gravity in the event of system failure to facilitate the positioning of the keeper 46 rearwardly with respect to the roller mount 36, or a latching member 90, thereby facilitating the latching of a door 21.

In some embodiments, groups of positioning slots 30 may be regularly spaced along the slide rod 20. The groups of positioning slots 30 may be spaced at regular 100 mm intervals to facilitate engagement, and adjustable positioning of, a keeper plate 44.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below (e.g. claim 3 may be taken as alternatively dependent from claim 2; claim 4 may be taken as alternatively dependent on claim 2, or on claim 3; claim 6 may be taken as alternatively dependent from claim 5; etc.).

This completes the description of the preferred and alternate embodiments of the invention. Those skilled in the art may recognize other equivalents to the specific embodiment described herein which equivalents are intended to be encompassed by the claims attached hereto.

The invention claimed is:

1. A latching device for a vertically extending door within a door frame, said latching device comprising:

a) a slide rod adapted to be engaged to said vertically extending door, said slide rod defining a longitudinal vertical axis, the slide rod moveable vertically along said longitudinal vertical axis relative to said vertically extending door between at least one first position and at least one second position, the slide rod having a first portion and a longitudinally opposed second portion, said first portion configured for operable engagement with a handle;

b) a keeper plate engaged to said second portion of said slide rod, said keeper plate comprising a keeper;

c) a positioning bracket adapted to be engaged to said vertically extending door, said positioning bracket comprising a slide channel and a roller slot, said slide rod being disposed in said slide channel, said slide rod being vertically moveable in said slide channel relative to said positioning bracket; and d) a roller bracket adapted to be engaged to said door frame, said roller bracket comprising a roller, said roller slot being constructed and arranged for receipt of said roller during rotation of said vertically extending door within said door frame, said roller slot receiving said roller in a direction substantially orthogonal to said longitudinal vertical axis, said keeper being constructed and arranged for releasable engagement to said roller in a direction along said longitudinal vertical axis, wherein when the roller slot has received the roller, the keeper plate has a first state when the slide rod is in said at least one first position and a second state when the slide rod is in said at least one second position, in the first state, the keeper plate is disengaged from said roller, and in the second state, the keeper plate is vertically positioned to engage said roller, wherein said roller is releasably secured within said roller slot.

2. The latching device according to claim 1, wherein said keeper plate is at least partially disposed in said slide channel when said keeper is engaged to said roller.

3. The latching device according to claim 2, wherein said keeper is constructed and arranged for positioning between said roller and a doorframe channel.

4. The latching device according to claim 3, said keeper comprising opposite ends, each of said opposite ends being beveled.

5. The latching device according to claim 3, said keeper being substantially perpendicular to said keeper plate.

6. The latching device according to claim 3, said positioning bracket comprising at least one bridge.

7. The latching device according to claim 6, said at least one bridge defining a keeper channel.

8. The latching device according to claim 3, further comprising a first release position when said keeper is disengaged from said roller.

9. The latching device according to claim 8, further comprising a latch position upon engagement of said keeper to said roller.

10. The latching device according to claim 3, said roller bracket comprising a roller mount, said roller being rotatably engaged to said roller mount.

11. The latching device according to claim 10, wherein said roller mount separates said roller from a doorframe back wall.

12. The latching device of claim 1, wherein said keeper extends outwardly in a direction substantially perpendicular to said keeper plate and said slide rod.

13. A latching device comprising:

a first bracket adapted to be engaged to a vertically extending door, said first bracket comprising a slot, a slide channel and a slide rod, the slide rod defining a longitudinal vertical axis, the slide rod having a first portion and a second portion, the second portion being separated from said first portion along a length of the slide rod, the first portion configured for operable engagement with a handle, the slide rod disposed in the slide channel, the slide rod further comprising a keeper, said keeper being engaged to the second portion, the slide rod vertically actuatable relative to said first bracket along said longitudinal vertical axis between first and second positions;

a second bracket adapted to be engaged to a door frame, said second bracket comprising a latch, said latch comprising a roller, said vertically extending door having a closed door position and an open door position, the roller oriented for positioning within the slot of the first bracket in said closed door position;

wherein the keeper moves in a direction along said longitudinal vertical axis to releasably engage the roller in said closed door position when the slide rod is in the first position and disengage the roller in said open door position when the slide rod is in the second position.

14. The latching device of claim 13, wherein said keeper extends outwardly in a direction substantially perpendicular to said slide rod.

15. A latching device comprising:

a first bracket adapted to be engaged to a vertically extending door within a door frame, said first bracket comprising a body portion and a positionable rod, said positionable rod defining a longitudinal vertical axis, said positionable rod moveable vertically with respect to said body portion along said longitudinal vertical axis between a first position and a second position, the positionable rod having a first portion and a second portion, the second portion being separated from said first portion along a length of the positionable rod, the first portion configured for operable engagement with a handle, said positionable rod comprising a keeper, said keeper fixedly engaged to the second portion; and a second bracket adapted to be engaged to the door frame, said first bracket being moveable in a direction orthogonal with respect to said second bracket and said longitudinal vertical axis during rotation of said vertically extending door between a proximate position relative to said door frame and a nonproximate position relative to said door frame, the second bracket comprising an engagable portion comprising a latch comprising a roller;

wherein when said positionable rod is in the first position, said keeper is vertically disposed to engage the roller of said second bracket to retain at least a portion of said second bracket in said proximate position.

16. The latching device of claim 15, wherein said keeper comprises a flat surface.

17. The latching device of claim 16, wherein said keeper defines a plane oriented parallel to the longitudinal vertical axis of said positionable rod, said engagable portion of said second bracket passes through said plane as said first bracket is moved out of said proximate position.

18. The latching device of claim 15, wherein said keeper extends outwardly in a direction substantially perpendicular to said slide rod.

19. A latching device for a vertically extending door within a door frame, said latching device comprising:

a) a slide rod adapted to be engaged to said vertically extending door, said slide rod defining a longitudinal vertical axis, the slide rod moveable vertically along said longitudinal vertical axis relative to said vertically extending door between at least one first position and at least one second position, the slide rod having a first portion and a second portion, the second portion displaced from the first portion along a length of the slide rod, said first portion configured for operable engagement with a handle;

b) a keeper plate engaged to said second portion of said slide rod, said keeper plate comprising a keeper;

c) a positioning bracket adapted to be engaged to said vertically extending door, said positioning bracket comprising a slide channel and a roller slot, said slide rod being disposed in said slide channel, said slide rod being vertically moveable in said slide channel relative to said positioning bracket; and d) a roller bracket adapted to be engaged to said door frame, said roller bracket comprising a roller, said roller slot being constructed and arranged for receipt of said roller during rotation of said vertically extending door within said door frame, said roller slot receiving said roller in a direction substantially orthogonal to said longitudinal vertical axis, said keeper being constructed and arranged for releasable engagement to said roller in a direction along said longitudinal vertical axis, wherein when the roller slot has received the roller, the keeper plate has a first state when the slide rod is in said at least one first position and a second state when the slide rod is in said at least one second position, in the first state, the keeper plate is disengaged from said roller, and in the second state, the keeper plate is vertically positioned to engage said roller, wherein said roller is releasably secured within said roller slot.

20. A latching device comprising:

a first bracket adapted to be engaged to a vertically extending door, said first bracket comprising a slot, a slide channel and a slide rod, the slide rod defining a longitudinal vertical axis, the slide rod having a first portion and a second portion, the second portion being separated from said first portion along a length of the slide rod, the second portion configured for operable engagement with a handle, the slide rod disposed in the slide channel, the slide rod further comprising a keeper, said keeper being engaged to the first portion, the slide rod vertically actuatable relative to said first bracket along said longitudinal vertical axis between first and second positions;

a second bracket adapted to be engaged to a door frame, said second bracket comprising a latch, said latch comprising a roller, said vertically extending door having a closed door position and an open door position, the roller oriented for positioning within the slot of the first bracket in said closed door position;

wherein the keeper moves in a direction along said longitudinal vertical axis to releasably engage the roller in said closed door position when the slide rod is in the first position and disengage the roller in said open door position when the slide rod is in the second position.

21. A latching device comprising:

a first bracket adapted to be engaged to a vertically extending door within a door frame, said first bracket comprising a body portion and a positionable rod, said positionable rod defining a longitudinal vertical axis, said positionable rod moveable vertically with respect to said body portion along said longitudinal vertical axis between a first position and a second position, the positionable rod having a first portion and a second portion, the second portion being separated from said first portion along a length of the positionable rod, the second portion configured for operable engagement with a handle, said positionable rod comprising a keeper, said keeper fixedly engaged to the first portion; and a second bracket adapted to be engaged to the door frame, said first bracket being moveable in a direction orthogonal with respect to said second bracket and said longitudinal vertical axis during rotation of said vertically extending door between a proximate position relative to said door frame and a nonproximate position relative to said door frame, the second bracket comprising an engagable portion comprising a latch comprising a roller;

wherein when said positionable rod is in the first position, said keeper is vertically disposed to engage the roller of said second bracket to retain at least a portion of said second bracket in said proximate position.

* * * * *